US006171080B1

(12) United States Patent
Watanabe et al.

(10) Patent No.: US 6,171,080 B1
(45) Date of Patent: Jan. 9, 2001

(54) IMMERSED VERTICAL PUMP WITH REDUCED THRUST LOADING

(75) Inventors: Mitsuhiro Watanabe, Tsukuba-gun; Tomokazu Fujita, Himeji, both of (JP)

(73) Assignee: SMC Corporation, Tokyo (JP)

( * ) Notice: Under 35 U.S.C. 154(b), the term of this patent shall be extended for 0 days.

(21) Appl. No.: 09/244,176

(22) Filed: Feb. 4, 1999

(30) Foreign Application Priority Data

Feb. 24, 1998 (JP) ..... 10-058873

(51) Int. Cl.[7] ..... F04B 17/00
(52) U.S. Cl. ..... 417/423.3; 417/423.14
(58) Field of Search ..... 417/423.14, 421, 417/247, 423.3

(56) References Cited

U.S. PATENT DOCUMENTS

| | | | | |
|---|---|---|---|---|
| 2,166,758 | * | 6/1939 | Franck | 103/97 |
| 2,470,563 | * | 5/1949 | Jennings | 103/87 |
| 2,478,941 | * | 8/1949 | Piccardo | 103/5 |
| 2,997,957 | * | 8/1961 | Hall | 103/87 |
| 3,723,019 | * | 3/1973 | Berman | 415/53 |
| 4,930,996 | * | 6/1990 | Jensen et al. | 417/373 |
| 4,978,281 | * | 12/1990 | Conger | 417/423.15 |
| 5,051,071 | * | 9/1991 | Haentjens | 417/373 |
| 5,407,323 | * | 4/1995 | Gay et al. | 415/200 |
| 5,549,450 | * | 8/1996 | Mann et al. | 415/214.1 |

FOREIGN PATENT DOCUMENTS

| | | |
|---|---|---|
| 558 040 | 12/1943 | (GB) . |
| 599 988 | 3/1948 | (GB) . |
| 614 442 | 12/1948 | (GB) . |
| 1 373 039 | 11/1974 | (GB) . |
| 1 428 533 | 3/1976 | (GB) . |
| 2 248 406 | 4/1992 | (GB) . |

* cited by examiner

*Primary Examiner*—Charles G. Freay
*Assistant Examiner*—Timothy P Solak
(74) *Attorney, Agent, or Firm*—Oblon, Spivak, McClelland, Maier & Neustadt, P.C.

(57) ABSTRACT

For an immersed pump having a suction port directly immersed in a liquid for operation, the present invention provides a pump that eliminates the need to seal a rotating shaft with a shaft sealing apparatus and that reduces the effect on individual pump sections of a) the thrust of the rotating shaft effected by the rotation of an impeller and b) the weight of a motor acting in the same direction, thereby preventing defects in the pump.

To achieve this object, this invention provides an immersed pump configured in such a way that an impeller 7 is driven and rotated by a motor 2 to draw a liquid from a suction port 4A into a pump housing 3A and eject it from an ejection port 5. The suction port 4A is provided at the lower end of a body frame 1 or on the outer circumference of the upper end of the housing 3A, while the ejection port 5 is provided at the lower end of the housing 3A.

4 Claims, 3 Drawing Sheets

FIG. 4 *PRIOR ART*
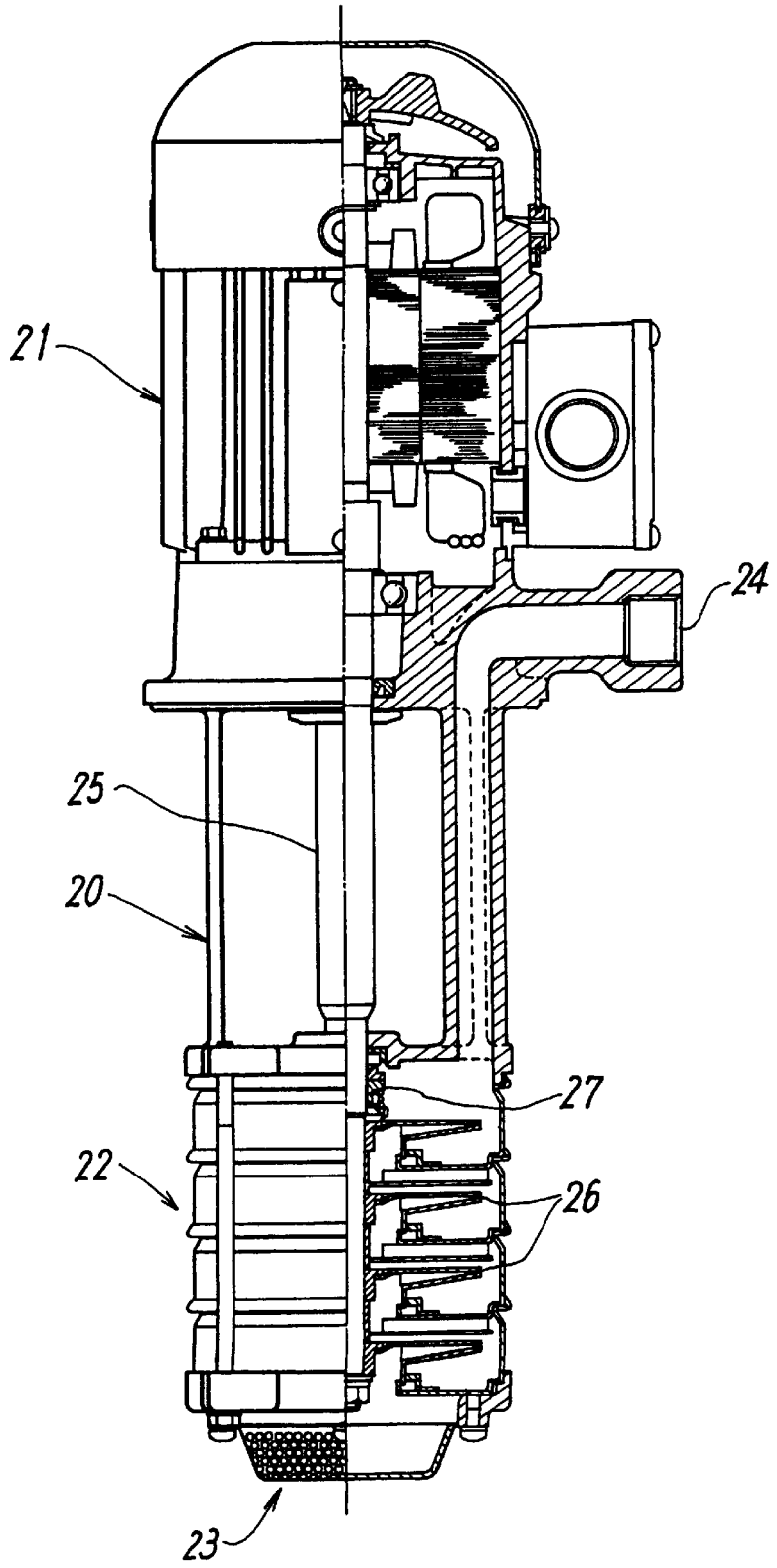

IMMERSED VERTICAL PUMP WITH REDUCED THRUST LOADING

FIELD OF THE INVENTION

The present invention relates to an immersed pump having a suction port directly immersed in a liquid for operation.

PRIOR ART

Immersed pumps having a suction port immersed in a liquid so as to draw in the liquid have been widely known. As shown in FIG. 4, conventional immersed pumps are generally configured so that an impeller 26 mounted at the tip of a rotating shaft 25 is driven and rotated by a motor 21 mounted at the upper end of a body frame 20, in order to draw in a liquid from a suction port 23 provided at the lower end of a housing 22 at the lower end of the body frame 20. The liquid is then pressurized and discharged sideward from a ejection port 24 at the upper end of the frame through a channel in the side of the body frame 20.

Since an immersed pump of this type force-feeds a liquid upward, the liquid may leak to the frame 20 through the circumference of the motor's rotating shaft 25. Thus, a shaft sealing apparatus 27 such as a mechanical seal must be used to support and seal the rotating shaft 25 to prevent leakage. Accordingly, maintenance or replacement of the shaft sealing apparatus 27, which is associated with usage frequency, can be so cumbersome that the lifetime expectancy of the pump decreases.

In addition, since the liquid drawn in from the center of the lower end of the housing 22, pressurized, and ejected sideward from the body frame 20, a lateral force may be imparted to the rotating shaft 25 to vibrate and deform it, thereby vibrating the entire pump and creating loud noise.

Furthermore, since the thrust of the rotating shaft 25 effected by the rotation of the impeller 26 acts in the same direction as the weight of the motor 21, a large force may be applied to each section of the pump, particularly a bearing which supports the rotating shaft 25 mounted in the body frame 20, resulting in defects.

DISCLOSURE OF THE INVENTION

It is a technical object of this invention to improve the above immersed pump, by altering its design in such a way that the pump transfers a liquid downward, thereby eliminating the need to seal the shaft with a shaft sealing apparatus—and thus the need for maintenance/replacement associated with such sealing—and reducing the effect on individual pump sections of a) the thrust of the rotating shaft effected by the rotation of the impeller and b) the weight of the motor acting in the same direction. This improved design should provide an immersed pump that can reduce the incidence of defects.

It is another technical object to provide an immersed pump that precludes a lateral force caused by the ejected liquid from being imparted to the rotating shaft, in order to prevent vibration and/or deformation of the rotating shaft as well as vibrations affecting the entire pump.

To achieve these objects, this invention provides an immersed pump comprising a body frame, a motor mounted at the upper end of the body frame, a pump housing mounted at the lower end of the body frame, a rotating shaft extending from the motor through the inside of the body frame to the housing, and at least one impeller attached to the rotating shaft in the housing, the impeller being driven and rotated by the motor to draw a liquid in a tank from a suction port into the housing and eject it from an ejection port, characterized in that the suction port is provided above the impeller, and in that the ejection port is provided at the lower end of the housing.

Since the suction port through which a liquid is drawn in is provided above the impeller installation position so that the liquid drawn into the housing is force-fed downward, use of a shaft sealing apparatus such as a conventional mechanical seal can be omitted to eliminate the need for cumbersome maintenance and replacement of the apparatus.

In addition, the upward thrust of the rotating shaft effected by the rotation of the impeller offsets the downward weight of the motor, thus reducing the force imparted to each section of the pump. Consequently, it is possible to prevent defects that may occur in conventional pumps in which the motor's thrust and gravitational force act in the same direction.

Furthermore, the liquid drawn into the housing is force-fed downward therein, thereby precluding a lateral force from being applied to the rotating shaft despite the ejection of the pumped liquid. This configuration further prevents the rotating shaft from being vibrated or deformed and avoids vibration of the entire pump that result in noise.

According to the immersed pump described in this invention, the ejection port is provided on an extension of the axis of the rotating shaft, and a joint that is directly joined with an ejection hole provided at the bottom of the tank is mounted in the ejection port.

Moreover, according to this invention, the housing is formed by coupling a plurality of short, cylinder-shaped housing members together in the vertical direction, and an impeller is provided in each of at least some of the housing members. In this case, the impellers are provided in some of the lower housing members while a suction port is provided on the outer circumference of each of at least some of the remaining upper housing members.

In addition, desirably, the plurality of housing members are detachably coupled together, and each of the impellers is remorably attached to the rotating shaft.

BRIEF DESCRIPTION OF THE DRAWINGS

FIG. 4 is a vertical sectional front view showing a conventional immersed pump.

DETAILED DESCRIPTION

Figure 1:
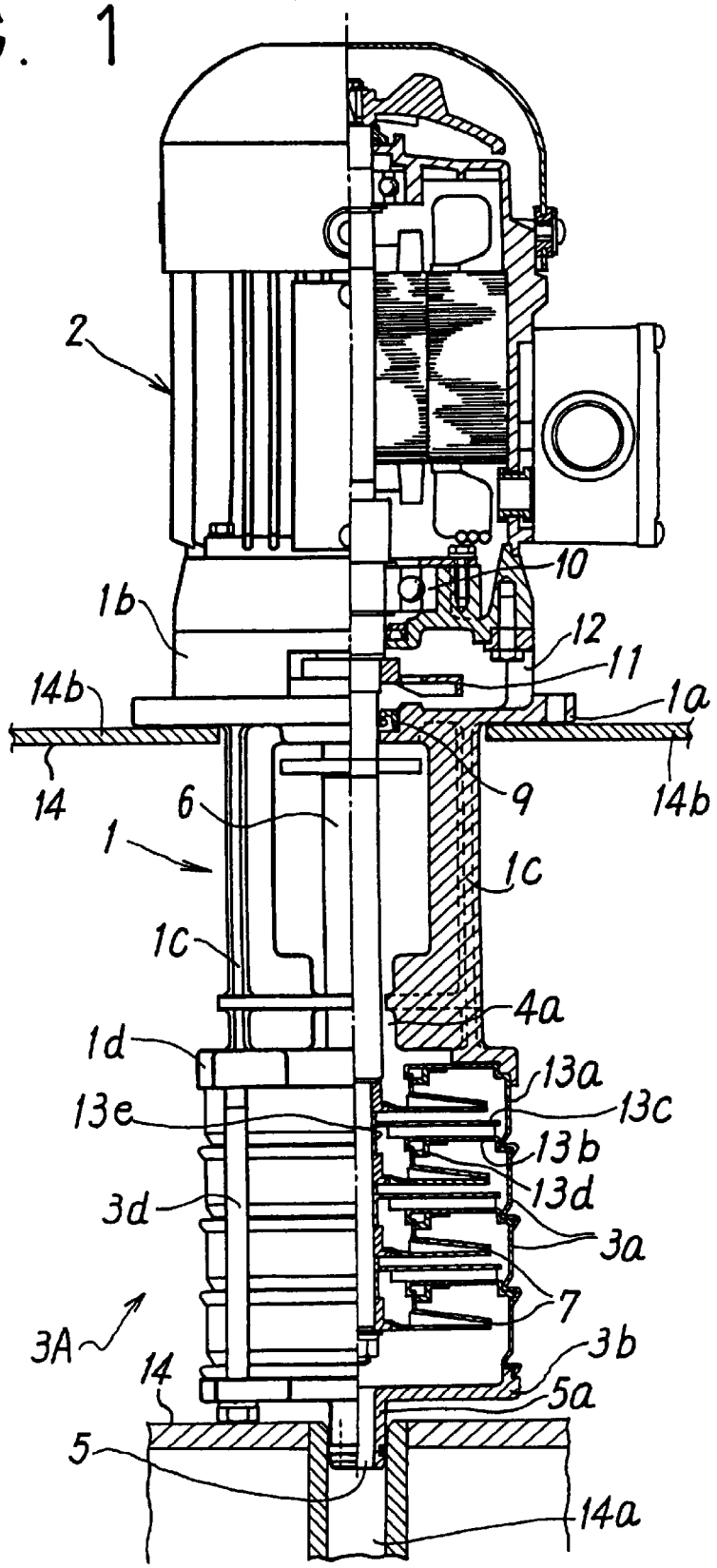
FIG. 1 is a vertical sectional front view showing a first embodiment of this invention.

FIG. 1 shows a first embodiment of this invention. An immersed pump according to this embodiment comprises a body frame 1, a motor 2 mounted at the upper end of the body frame 1, a pump housing 3A mounted at the lower end of the frame 1, a rotating shaft 6 extending from the motor 2 through the frame 1 to the housing 3A, and a plurality of impellers 7 provided at the tip of the rotating shaft 6 in the housing 3A.

The body frame 1 fixes the motor 2 and the housing 3A, and comprises a mounting frame 1*a* mounted on a cover 14*b* of the tank 14 for a force-fed liquid, a hollow portion 1*b* provided at the upper end of the mounting frame 1*a* and having a ventilating opening 12, a plurality of columnar portions 1*c* provided at the lower end of the mounting frame 1*a,* and a dish-shaped housing mounting section 1*d* provided at the lower end of the columnar portion 1*c*.

A hole is drilled in the center of the mounting frame 1*a* of the body frame 1 and the center of the housing mounting section 1*d* to allow the rotating shaft 6 to be inserted. A bearing 9 allowing the rotating shaft 6 to pass rotatably is mounted in the hole in the mounting frame 1*a*.

At the same time, the hole in the housing mounting section 1*d* is drilled larger than the diameter of the rotating shaft 6, and the intermediate area between this hole and the rotating shaft 6 constitutes a suction port 4A from which a liquid is drawn into the housing 3A through the columnar portion 1*c*.

The rotating shaft 6 is formed integrally with the shaft of the motor 2 and is supported in the middle of the body frame 1 using a rolling bearing 10 within a motor casing.

The rotating shaft 6 has a fan 11 located in the hollow portion 1*b* of the body frame 1 to allow heat generated by the rotation of the motor 2 to escape through the ventilating opening 12 and to cool the rotating shaft 6, which is heated by the motor.

The pump housing 3A is composed of a plurality of housing members 3*a* detachably coupled together, and of a housing bottom cover member 3*b* mounted at the lower end of the housing member 3*a* located in the lowest stage, and is tightened and fixed to the body frame 1 using a mounting bolt 3*d* passed through the bottom-cover member 3*b*.

Each housing member 3*a* comprises an outer circumferential wall 13*a,* a partitioning wall 13*b* integrally provided at one end of the outer circumferential wall 13*a* to partition each pump chamber, wherein the walls are each shaped like a short cylinder. Each of the housing members except for the top one possesses on the partitioning wall 13*b* a guide vane standing upward and a partitioning plate 13*c* provided at the upper end of the guide vane, which are both provided integrally with the partitioning wall 13*b*. Thus, a gap for liquid to flow is formed between the partitioning wall 13*b* and the partitioning plate 13*c* in such a way that the guide vanes are able to guide the liquid through the gap.

The partitioning wall 13*b* has a suction hole opened at its center between its end and the rotating shaft 6 as well as a seal section 13*d* that seals the intermediate area between the wall 13*b* and the impeller 7.

In addition, the middle of the partitioning plate 13*c* is integrated with a sleeve 13*e* on the rotating shaft 6, and the outer circumference of the partitioning plate 13*c* is opposed to the inside of the outer circumferential wall 13*a* of the adjacent housing member in such a way as to form a channel between them.

By fitting an end of the outer circumferential wall 13*a* on the proximal end of the adjacent outer circumferential wall 13*a,* the housing members 3*a* are coupled together in such a way that their interior surfaces are sealed.

The bottom cover member 3*b* comprises in its middle (i.e., on the extension of the rotating shaft 6), an ejection port 5 through which a liquid is ejected downward. The ejection port 5 is directly inserted into an ejection hole 14*a* provided at the bottom of the tank 14 as a junction and forms a protruding joint 5*a* that allows the pump to be installed in the tank.

A seal member consisting of a rubber O ring is mounted around the joint 5*a* of the ejection port 5 to prevent a liquid from leaking from the junction of the ejection hole 14*a*.

Four impellers 7 attached to the tip of the rotating shaft 6 at a specified interval in such a way as to form stages are arranged in the housing 3A so as to correspond to the housing members 3*a* in the respective stages. The impeller 7 is driven and rotated by the motor 2 to draw a liquid from the suction port 4A sequentially into each housing member 3*a* while sequentially force-feeding the drawn liquid to the lower impeller 7 until the drawn liquid is ejected from the ejection port 5. In this case, the thrust of the rotating shaft 6 effected by the rotation of the impeller 7 acts in an upward direction.

The impeller 7 does not need to be provided in all housing members 3*a;* it may be provided in only some. The number of impellers 7 is reduced in this manner to enable the pump's drawing force to be regulated, so each impeller 7 is remorably attached to the rotating shaft 6.

Although this embodiment has been described in conjunction with the four housing members arranged in the vertical direction, this number can be increased or decreased as required. In addition, each impeller 7 can be attached to the rotating shaft 6 using an appropriate means, for example, by inserting keys into respective key grooves provided in a boss of the impeller 7 and in the rotating shaft 6 for fixation, or by tightening screws to fix the impeller.

The immersed pump of this configuration is installed for operation by immersing the housing 3A in a liquid and joining the ejection port 5 with the ejection hole 14*a* at the bottom of the tank 14. This mode of installation enables piping for the ejection port 5 to be completed.

During installation, the suction port 4A through which liquid is drawn in is positioned above the impellers 7 provided in the housing 3A, so that liquid drawn into the housing 3A is force-fed downward. Accordingly, a shaft sealing apparatus such as a conventional mechanical seal can be omitted, thereby obviating the need for cumbersome maintenance and replacement of the apparatus.

In addition, the impellers 7 are attached to the rotating shaft 6 so that the thrust of the rotating shaft 6 acts in an upward direction. Thus, the thrust offsets the downward weight of the motor 2 to substantially reduce the force applied to each section of the pump, particularly to the rolling bearing 10 supporting the rotating shaft 6.

As a result, defects that may occur when the thrust and the weight of the motor 2 act in the same direction can be prevented.

Moreover, the liquid drawn into the housing 3A is force-fed downward, drawn in through the circumference of the upper end of the housing 3A, and ejected downward from the ejection port 5 provided on the extension of the axis of the rotating shaft 6. This configuration precludes a lateral force effected by the ejected liquid from being applied to the rotating shaft 6, thereby preventing the rotating shaft 6 from being vibrated or deformed while also preventing noises caused by the vibration of the entire pump.

Although this embodiment provides the ejection port 5 on an extension of the axis of the rotating shaft 6, this invention is not limited to this aspect; instead, a plurality of ejection ports may be disposed around the axis in a balanced manner.

Figure 2:
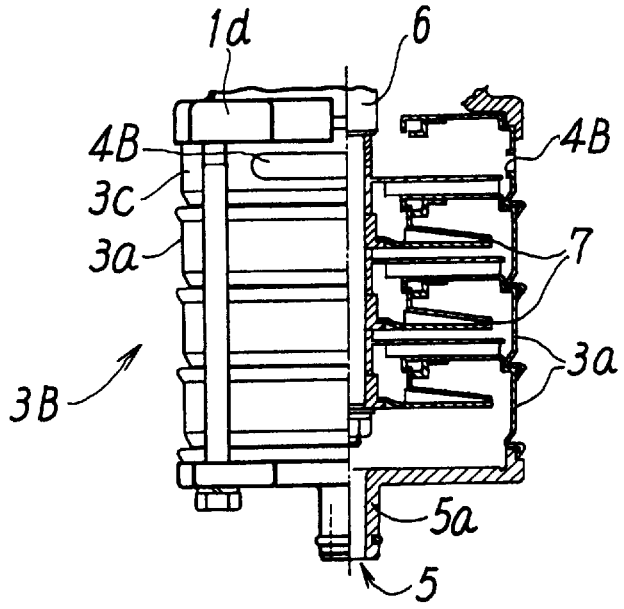
FIG. 2 is a vertical sectional front view showing the main feature of a second embodiment of this invention.
Figure 3:
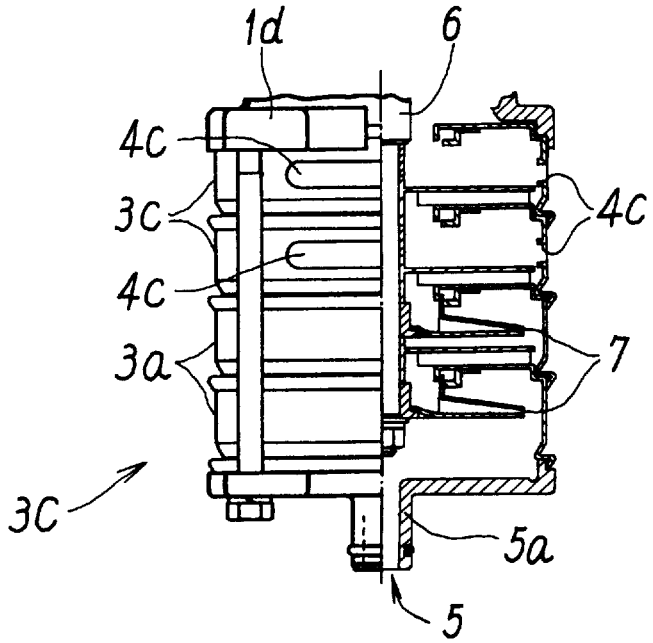
FIG. 3 is a vertical sectional front view showing the main feature of a third embodiment different from the second embodiment.

In addition, although the first embodiment provides the liquid suction port 4A at the lower end of the body frame 1, suction ports 4B and 4C may be provided on the outer circumferences of the upper ends of housings 3B and 3C, respectively, or may be provided at both the upper end of the housing and the lower end of the body frame, as in a second and a third embodiments, which are shown in FIGS. 2 and 3, respectively.

That is, the housing 3B according to the second embodiment is formed of the four housing members 3*a* arranged in a vertical direction, with an impeller 7 built into each of the three lower housing members 3*a*. The top housing member, which is without an impeller 7, is used as a spacer 3*c*, with the suction port 4B provided in the outer circumferential wall 13*a* of the spacer 3*c*. The housing members in the respective stages are detachably coupled together.

On the other hand, according to the third embodiment, the impeller 7 is built into each of the two lower housing members 3*a*. The two upper housing members without an impeller 7 are used as the spacers 3*c*, with the suction port 4C provided in each of the spacers 3*c*.

The second and third embodiments can be formed of the parts common to the first embodiment. By determining the numbers of lower housing members 3*a* and upper spacers 3*c* as appropriate in such a way that their sum is four or less, the ejection force of the pump can not only be adjusted but can also be set to some extent to correspond to the level of the liquid in the tank 14.

If, for example, the level of the liquid constantly stored in the tank 14 is higher than the housing 3A, the configuration shown in FIG. 1 can be used. However, to reduce the amount of liquid constantly stored in the tank 14 and thus the tank's level, one spacer 3*c* and three housing members 3*a* may be provided as in the housing 3B in FIG. 2. To further reduce the tank's level, two spacers 2*c* and two housing members 3*a* may be provided as in the housing 3C shown in FIG. 3.

In the second and third embodiments, the suction ports 4B and 4C may be porous or meshed.

In addition, the spacer 3*c* may be shaped like a simple cylinder without the suction port 4B or 4C.

In these embodiments, a plurality of ejection ports 5 may be disposed around the axis of the rotating shaft 6 in a balanced manner.

As described above in detail, according to the present immersed pump, the suction port through which a liquid is drawn in is provided above the housing so as to force-feed downward a liquid drawn into the housing, thereby preventing the drawn liquid from being force-fed upward through the circumference of the rotating shaft. Consequently, the conventional shaft sealing apparatus can be omitted to eliminate the needs for cumbersome maintenance and replacement of this apparatus.

In addition, the upward thrust of the rotating shaft effected by the rotation of the impeller offsets the downward weight of the motor to reduce the force applied to each section of the pump, thereby preventing defects that may occur in conventional pumps because the thrust and the weight of the motor act in the same direction.

Moreover, the liquid drawn into the housing is force-fed downward to preclude a lateral force effected by the ejected liquid from being applied to the rotating shaft 6, thereby preventing the rotating shaft from being vibrated or deformed while also preventing noise caused by the vibration of the entire pump.

What is claimed is:

1. An immersed pump comprising:

a body frame;

a motor mounted at an upper end of the body frame;

a pump housing mounted at a lower end of said body frame and formed entirely of a plurality of cylindrical housing members coupled together in a vertical direction, the housing members including lower housing members and upper housing members which are positioned above the lower housing members;

a rotating shaft extending from said motor through an inside of the body frame to said pump housing;

at least one impeller attached to the rotating shaft in the pump housing and provided in respective lower housing members;

at least one suction port provided on respective upper housing members;

an ejection port provided at a lower end of the pump housing; and the at least one impeller being rotated by said motor to draw a liquid in a tank from the at least one suction port into the pump housing and eject the liquid from the ejection port.

2. An immersed pump according claim 1, wherein said ejection port is provided on an extension of an axis of said rotating shaft, and wherein a joint that is directly joined with an ejection hole provided at a bottom of the tank is mounted in the ejection port.

3. An immersed pump according to claim 1, wherein said plurality of cylindrical housing members are detachably coupled together, and wherein each of said at least one impeller is removably attached to said rotating shaft.

4. An immersed pump according to claim 1, wherein said suction port is formed at the lower end of the body frame.

* * * * *